US008389886B2

(12) United States Patent
Dahlquist et al.

(10) Patent No.: US 8,389,886 B2
(45) Date of Patent: Mar. 5, 2013

(54) HIGH-VOLTAGE CIRCUIT BREAKER WITH IMPROVED CIRCUIT BREAKER RATING

(75) Inventors: Andreas Dahlquist, Zurich (CH); Christian Franck, Zurich (CH); Martin Kriegel, Unterehrendingen (CH); Martin Seeger, Zurich (CH); Henrik Nordborg, Baden (CH)

(73) Assignee: ABB Technology AG, Zurich (CH)

( * ) Notice: Subject to any disclaimer, the term of this patent is extended or adjusted under 35 U.S.C. 154(b) by 1178 days.

(21) Appl. No.: 11/520,619

(22) Filed: Sep. 14, 2006

(65) Prior Publication Data

US 2007/0068904 A1 Mar. 29, 2007

(30) Foreign Application Priority Data

Sep. 26, 2005 (EP) ..... 05405556

(51) Int. Cl.
*H01H 33/91* (2006.01)

(52) U.S. Cl. ..... 218/59; 218/45

(58) Field of Classification Search ..... 218/12–14, 218/43–47, 51–54, 59–64, 72, 73, 85, 90, 218/156–158
See application file for complete search history.

(56) References Cited

U.S. PATENT DOCUMENTS

| | | | | |
|---|---|---|---|---|
| 2,292,158 | A | 5/1941 | Prince | |
| 2,272,214 | A | 2/1942 | Linde | |
| 2,293,513 | A | 8/1942 | Linde | |
| 2,345,375 | A | 3/1944 | Bennett | |
| 3,005,892 | A | 10/1961 | Yarrick | |
| 3,025,376 | A | 3/1962 | Yarrick | |
| 4,144,426 | A | 3/1979 | Kowalik et al. | |
| 4,328,403 | A * | 5/1982 | Frink et al. | 218/60 |
| 4,471,187 | A | 9/1984 | Sturzenegger et al. | |
| 4,471,188 | A | 9/1984 | Van et al. | |
| 4,689,453 | A | 8/1987 | Horvath et al. | |

(Continued)

FOREIGN PATENT DOCUMENTS

| | | |
|---|---|---|
| CH | 655612 | 4/1986 |
| DE | 740646 | 10/1943 |

(Continued)

OTHER PUBLICATIONS

European Search Report dated Feb. 27, 2006 (with English translation of category of cited documents).

(Continued)

*Primary Examiner* — Amy Cohen Johnson
*Assistant Examiner* — Marina Fishman
(74) *Attorney, Agent, or Firm* — Buchanan Ingersoll & Rooney PC

(57) ABSTRACT

An electrical breaker device, in particular a high-voltage circuit breaker, and a method for improved quenching gas cooling are disclosed. Cold gas is stored intermediately in the exhaust region, and a first partial gas flow is guided to bypass the intermediately stored cold gas and to flow off into the breaker chamber, the intermediately stored cold gas being forcibly displaced out of the exhaust region with the aid of a second partial gas flow and being mixed with the first partial gas flow before flowing off into the breaker chamber housing. Exemplary embodiments relate, inter alia, to the design of the intermediate storage volume for the cold gas and to auxiliary means for precooling the hot quenching gas. Advantages are, inter alia, improved quenching gas cooling, an increased circuit breaker rating and/or a more compact breaker design.

31 Claims, 8 Drawing Sheets

U.S. PATENT DOCUMENTS

| | | | | |
|---|---|---|---|---|
| 4,698,469 | A | 10/1987 | Pham et al. | |
| 4,749,831 | A | 6/1988 | Hosomi et al. | |
| 5,717,183 | A | 2/1998 | Lehmann et al. | |
| 5,793,597 | A | 8/1998 | Mizufune et al. | |
| 5,977,502 | A * | 11/1999 | Mizoguchi et al. | 218/43 |
| 6,646,850 | B1 | 11/2003 | Bergmann et al. | |
| 6,717,791 | B1 * | 4/2004 | Wiesinger | 361/123 |
| 6,872,907 | B2 | 3/2005 | Claessens et al. | |
| 7,022,922 | B2 | 4/2006 | Nowakowski | |
| 7,041,928 | B2 | 5/2006 | Nowakowski | |
| 7,402,771 | B2 | 7/2008 | Ye et al. | |
| 2002/0113040 | A1 | 8/2002 | Imamura et al. | |
| 2003/0017335 | A1 | 1/2003 | Cermignani et al. | |
| 2004/0057167 | A1 | 3/2004 | Claessens et al. | |
| 2004/0256361 | A1 | 12/2004 | Nowakowski | |
| 2005/0150868 | A1 | 7/2005 | Nowakowski | |
| 2005/0173378 | A1 | 8/2005 | Nowakowski | |

FOREIGN PATENT DOCUMENTS

| | | | |
|---|---|---|---|
| DE | 755056 | | 7/1953 |
| DE | 1 889 068 | | 3/1964 |
| DE | 26 42 693 | A1 | 3/1978 |
| DE | 2947957 | | 12/1980 |
| DE | 3009504 | A1 | 6/1981 |
| DE | 3915700 | | 11/1990 |
| DE | 9314779 | | 1/1994 |
| DE | 19547522 | | 12/1995 |
| DE | 19720090 | | 11/1998 |
| DE | 19832709 | | 1/2000 |
| DE | 19928080 | | 2/2001 |
| DE | 10221576 | | 12/2003 |
| DE | 102 21 580 | B3 | 1/2004 |
| EP | 0019806 | | 12/1980 |
| EP | 0076668 | A2 | 4/1983 |
| EP | 0195904 | | 10/1986 |
| EP | 0933795 | | 8/1999 |
| EP | 1 403 891 | | 3/2004 |
| EP | 1 444 713 | | 8/2004 |
| EP | 1605485 | | 12/2005 |
| JP | 5671223 | | 6/1981 |
| JP | 56104031 | | 8/1981 |
| JP | 58-71523 | | 4/1983 |
| JP | 61-269822 | | 11/1986 |
| JP | 2-172121 | | 7/1990 |
| JP | 2000-222987 | | 8/2000 |
| JP | 2003-272493 | | 9/2003 |
| JP | 2004-119344 | | 4/2004 |
| WO | 03/046939 | A1 | 6/2003 |
| WO | WO 2006/066420 | | 6/2006 |

OTHER PUBLICATIONS

Freeman et al, ABB Technik, Vereninfachte 80-kA-Leistungsschalter, Mar. 2002, 7 pps.

* cited by examiner

HIGH-VOLTAGE CIRCUIT BREAKER WITH IMPROVED CIRCUIT BREAKER RATING

TECHNICAL FIELD

The invention relates to the field of high-voltage engineering, in particular high-voltage circuit breakers in electrical power distribution systems. It is based on a method and a high-voltage circuit breaker in accordance with the precharacterizing clause of the independent patent claims.

PRIOR ART

In EP 1 444 713 B1 a flow-guiding device for a circuit breaker is disclosed, which device coaxially encloses the quenching-gas flow and has an outer surface or shell having two outflow openings. The outer surface of the flow-guiding device defines an exhaust gas volume. Partial flows of the quenching-gas flow emerge from the outflow openings into the breaker chamber volume. The outflow directions of the directly opposite outflow openings are directed such that they intersect one another. This means that the quenching gas is favourably mixed once it has passed through the respective outflow openings. The outlet openings may have associated additional swirling bodies or baffle plates in order to additionally swirl the quenching gas leaving the outlet openings. Owing to the mixing and swirling, the quenching-gas flow is decelerated at the inlet into the breaker chamber volume, is cooled and is dielectrically recovered in order to avoid flashovers to the breaker chamber housing.

In DE 102 21 580 B3 a high-voltage circuit breaker having an interrupter unit is disclosed, in which the exhaust gases are deflected twice through 180°. In order to improve the cooling of the gases, a concentrically arranged, hollow-cylindrical perforated plate, through which a flow passes radially, is provided on the fixed-contact side. The perforated plate serves as a heat sink which draws heat from the quenching gas. The perforated plate does increase the flow resistance for the quenching gas. In the region of the perforated plate a uniform, laminar quenching-gas flow is maintained.

In the utility model DE 1 889 068 U a switch disconnector with improved exhaust gas cooling is disclosed. The cooling apparatus comprises a plurality of pipes which are arranged concentrically in the gas outflow channel, each of which have diametrically opposing outflow openings, such that in the case of laminar outflow the quenching gases must traverse a labyrinth-like path with numerous deflections and must touch large surfaces of the cooling pipes. With this arrangement, the outflow path is prolonged and the cooling surface in the exhaust is enlarged.

In the EP 1 403 891 A1 a circuit breaker is disclosed, in which exhaust gas is likewise guided from an arcing chamber through a hollow contact into a concentrically arranged exhaust volume and from there into a quenching chamber volume which is positioned further outwards. In order to increase the breaking capacity or rating, at least one intermediate volume and possibly a secondary volume are arranged concentrically between the hollow contact and the exhaust volume and are separated from one another by intermediate walls which have holes or gas passage openings. Owing to the radial outflow of the quenching gases from the inner volumes to the outer volumes, the exhaust gases are directed in the form of jets onto the intermediate walls of the volumes and are swirled. Thus, heat is highly efficiently transmitted into the intermediate walls by turbulent convection.

The passage openings between the hollow contact volume, the intermediate volume and possibly the secondary volume are arranged such that they are offset with respect to one another on the circumference. The passage openings between the secondary volume and the exhaust volume are arranged such that they are offset with respect to one another on the circumference and/or in the axial direction. As a result, meandering or else helical exhaust gas paths are defined, the transit or dwell time of the exhaust gas in the exhaust region is increased, and the heat removal from the exhaust gas is improved. Overall, in addition to the hollow contact volume, the exhaust volume and the breaker chamber volume, at least one further intermediate volume is therefore also required in the circuit breaker in order to increase the efficiency of the exhaust gas cooling.

In the previously known breakers, cold gas which resides in the interrupter unit prior to the switching operation is forcibly displaced by hot exhaust gas flowing out of the arc zone and pushed out of the exhaust. The cold gas component to be forcibly displaced impedes the outflow of the hot exhaust gases and is wasted, without being used for cooling purposes.

The invention is based on the prior art according to the U.S. Pat. No. 4,471,187. This document discloses a high voltage circuit breaker having a dedicated exhaust design comprising a storage volume for cold gas. The exhaust gas or arc-quenching gas coming from the arc-quenching zone is split up into two partial gas flows. The first partial gas flow bypasses the cold-gas storage volume and directly flows off into the breaker chamber through an exhaust opening. The second partial gas flow traverses the cold-gas storage volume, thereby forcibly displaces the cold gas and urges it to enter the breaker chamber, as well. The exhaust opening for the first partial gas flow and the outflow opening of the displaced cold gas flow are arranged in vicinity of one another at the entrance for exhaust gas into the breaker chamber. Therefore, the hot first partial gas flow and the displaced cold gas flow are not mixed together until they enter the breaker chamber. Furthermore, in both the hot and cold gas flows, turbulences or eddies are avoided and a laminar flow behaviour is maintained to the extent possible in order to achieve a high throughput rate of are-quenching gas flowing off from the arc-quenching zone through the exhaust region into the breaker chamber housing.

DESCRIPTION OF THE INVENTION

The object of the present invention is to specify a method for cooling a quenching gas in an electrical breaker device and an associated electrical breaker device having an improved circuit breaker rating. This object is achieved according to the invention by the features of the independent claims.

The invention consists in a method for cooling a quenching gas in an electrical breaker device for electrical power supply systems, in particular in a high-voltage circuit breaker, the breaker device comprising a breaker chamber which is surrounded by a breaker chamber housing, wherein in the event of a switching operation hot quenching gas flows from an arc-quenching zone to an exhaust region filled with cold gas, and wherein the hot quenching gas is split up into at least two partial gas flows, wherein further at least part of the cold gas is intermediately stored in the exhaust region, and the first partial gas flow is guided to bypass the intermediately stored cold gas and flows off or away into the breaker chamber, and with the aid of the second partial gas flow the intermediately stored cold gas is forcibly displaced out of the exhaust region, wherein further the first partial gas flow and the intermediately stored cold gas are mixed with one another in a mixing zone before flowing off into the breaker chamber housing. Owing to the intermediate storage of the cold gas and the mixing with the first hot partial gas flow, this hot partial gas flow is efficiently cooled. This cooling takes place at a very early moment when the first partial gas flow flows out of the arc-quenching zone. Cold gas present in the exhaust volume is not forcibly displaced out without being used, but rather is used for exhaust gas cooling. The displacement of the cold gas out of the intermediate storage volume is effected by the second partial gas flow, in particular by this second partial gas flow flowing through the intermediate storage volume, or by the intermediate storage volume being reduced in size owing to this second partial gas flow, for example by gas pressure being exerted on a movably positioned wall of the intermediate storage volume, or by said second partial gas flow producing a low pressure and, as a result, sucking the cold gas out of the intermediate storage volume, by a combination of such effects or in another manner. Owing to the improved cooling, the quenching gas undergoes more effective dielectric recovery than was previously the case, the circuit breaker rating can be increased, and/or the breaker chamber housing can be dimensioned to be more compact, in particular narrower, without the risk of electrical flashovers between the quenching gas flowing off and the breaker chamber housing.

The exemplary embodiments specify advantageous geometries and preferred dimensioning criteria for the exhaust region and, in particular, for the intermediate storage volume, the mixing zone and an optional mixing channel.

The exemplary embodiments have the advantage that the first partial gas flow flows out of the exhaust essentially at the same time as the stored cold gas, which is forcibly displaced out of the exhaust region and, in particular, out of the intermediate storage volume by the second partial gas flow.

Further the disclosed exemplary embodiments specify different variants and installation locations for auxiliary means with which the quenching gas can additionally be cooled. With advantage, the first and/or second partial gas flow is additionally cooled by the formation of gas jets and swirling of gas jets on a baffle wall.

One further aspect of the invention is also an electrical breaker device for an electrical power supply system, in particular a high-voltage circuit breaker. The breaker device comprises a breaker chamber which is surrounded by a breaker chamber housing and has an arc-quenching zone and an exhaust volume for cooling hot quenching gas, an exhaust region of the exhaust volume being filled with cold gas at the beginning of a switching operation, means being provided for splitting the hot quenching gas up into at least two partial gas flows, in addition an intermediate storage volume being provided in the exhaust region for storing cold gas, a first means being provided which guides the first partial gas flow into the breaker chamber housing whilst bypassing the intermediate storage volume, and a second means being provided which guides the second partial gas flow towards the stored cold gas and, as a result, causes the stored cold gas to be forcibly displaced out of the intermediate storage volume, wherein further a mixing zone is provided in the region of an outlet opening of the intermediate storage volume for mixing the first partial gas flow with the cold gas such that the first partial gas flow and the intermediately stored cold gas are mixed with one another before flowing off into the breaker chamber housing.

Other exemplary embodiments specify preferred design embodiments for the intermediate storage volume.

Further embodiments, advantages and applications of the invention are given in the dependent claims, in the combinations of claims as well as in the description which now follows and the figures.

BRIEF DESCRIPTION OF THE DRAWINGS

There are shown schematically in.

In the figures same reference symbols are used for identical parts and repetitive reference symbols may be omitted.

WAYS TO IMPLEMENT THE INVENTION

Figure 1:
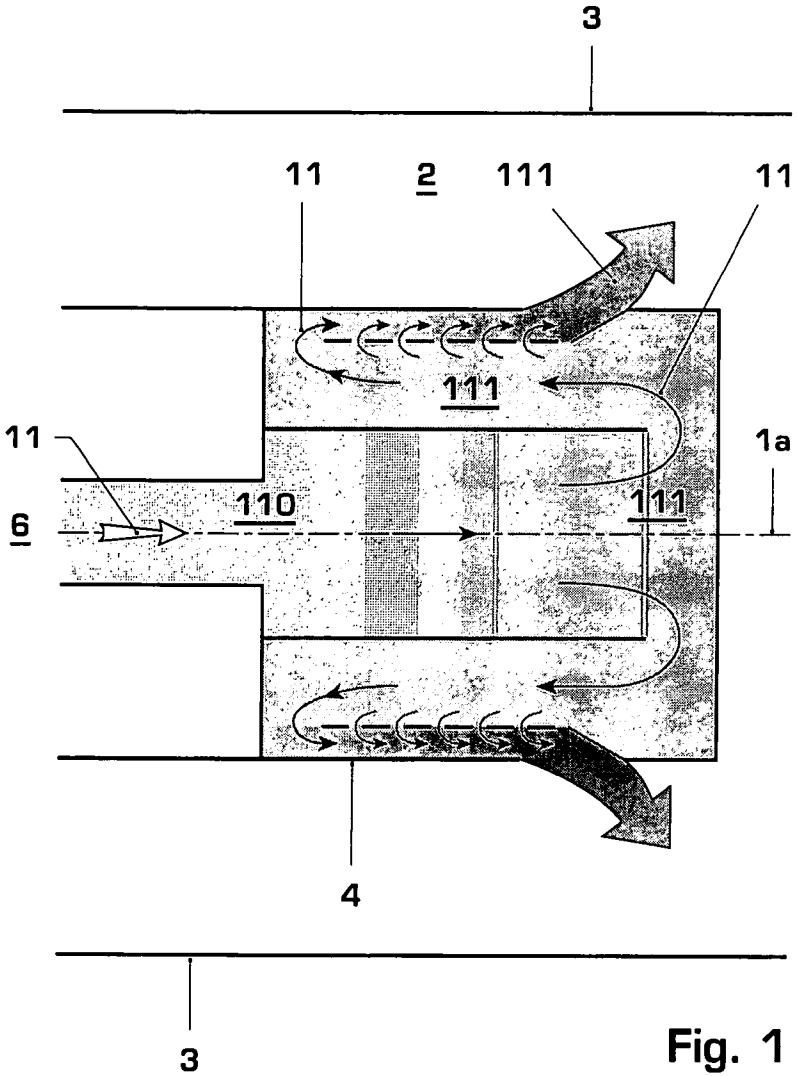
FIG. 1 the exhaust region of an interrupter unit with loss of cold gas in accordance with the prior art.

FIG. 1 shows, in simplified form, the exhaust region of a conventional high-voltage circuit breaker, which is designed concentrically about a breaker axis 1*a* and in which hot quenching gas 11, 110 flows from the arc-quenching zone 6 along a path, in this case a meandering path, out of the exhaust volume 4 into the breaker chamber 2. In this case, the cold gas 111 is forcibly displaced out of the exhaust region without contributing to the cooling of the quenching gas 11, 110.

Figure 2:
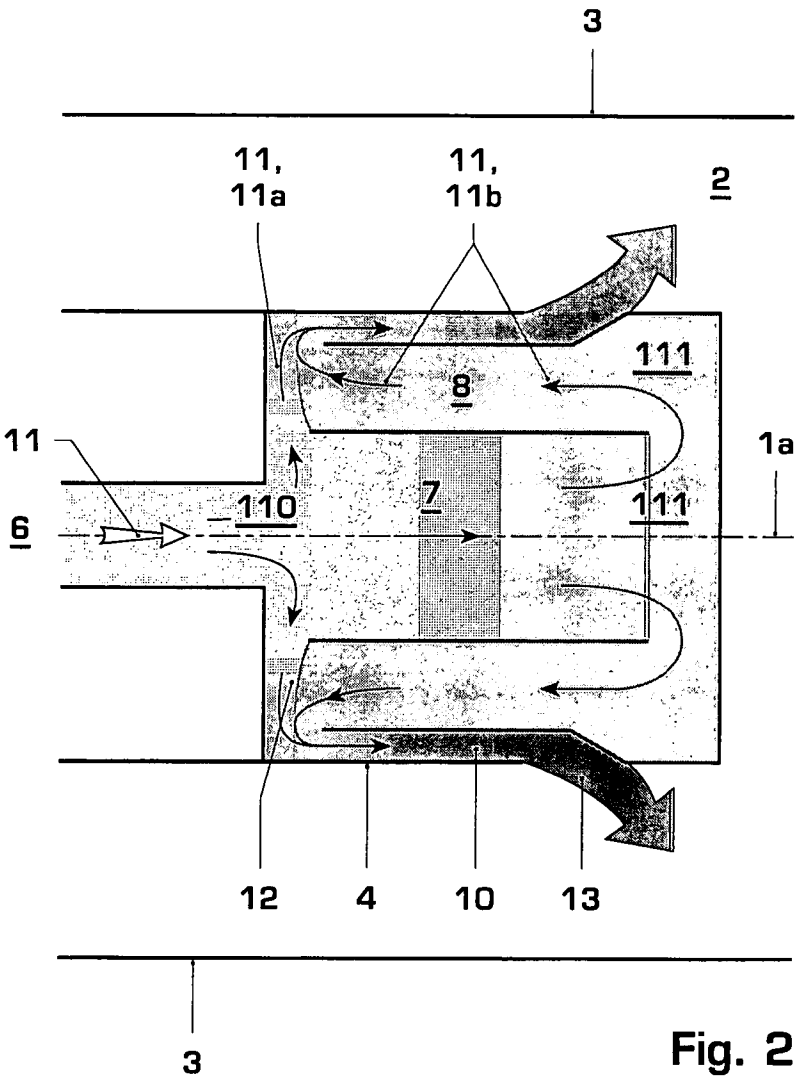
FIG. 2 a first embodiment of an exhaust region with mixing of hot gas and cold gas in accordance with the invention.

FIG. 2 shows, in simplified form, an exemplary embodiment for quenching gas cooling according to the invention. The hot quenching gas 11, 110 is split up into two partial gas flows 11*a*, 11*b*, at least part of the cold gas 111 is stored intermediately in the exhaust region 7, 8, the first partial gas flow 11*a* is guided to bypass the intermediately stored cold gas 111 and flows off into the breaker chamber 2, and, with the aid of the second partial gas flow 11*b*, the intermediately stored cold gas 111 is forcibly displaced out of the exhaust region 7, 8 and is mixed with the first partial gas flow 11*a* before flowing off into the breaker chamber housing 3. Even at the beginning of the discharge of quenching gas, the mixed quenching gas 13 has a markedly reduced temperature in comparison with the conventional exhaust shown in FIG. 1, in which initially cold gas 111 and then the relatively slightly cooled hot gas 110 flows off. Further exemplary embodiments of the quenching gas cooling method will be referred to below in conjunction with FIGS. 2-9.

In the quenching gas cooling method, the second partial gas flow 11*b* is guided towards the intermediately stored cold gas 111 in order to forcibly displace it directly or indirectly out of the exhaust volume 7, 8. FIGS. 2-9 each show the direct forcible displacement method, in which the second partial gas flow 11*b* flows through the intermediate storage volume 7, 8 and replaces the cold gas 111. However, an indirect forcible displacement method, for example by means of reducing the size of the intermediate storage volume 7, 8 and/or by sucking the gas out of the intermediate storage volume 7, 8, is also equally possible. The first partial gas flow 11*a* preferably flows off into the breaker chamber housing 3 over a shorter path, and the second partial gas flow 11*b* and possibly a third, fourth etc. partial gas flow 11*c* flows off into the breaker chamber housing 3 over a longer path. With the aid of the third or further partial gas flows 11*c*, the longer path can be divided up into at least two subpaths, namely into the second partial gas flow 11*b* and a third or further partial gas flow 11*c* assisting said second partial gas flow 11*b*. As a result, it is possible to achieve improved mixing of the quenching gas 11.

The intermediately stored part of the cold gas 111 is advantageously stored intermediately in the exhaust region in a cold-gas reservoir or intermediate storage volume 7, 8, the intermediate storage volume 7, 8 having an inlet opening 70 and an outlet opening 80 for the second partial gas flow 11*b* and the optional, further assisting partial gas flow 11*c* and having, in the region of the outlet opening 80, a mixing zone 12, in which the stored cold gas 111 is mixed with the first partial gas flow 11*a*.

Preferably, a low pressure is produced in the region of the mixing zone 12 by the first partial gas flow 11*a*, by which low pressure the intermediately stored cold gas 111 is sucked out of the intermediate storage volume 7, 8. The sucking may be effective on its own or in support of the forcible displacement of the cold gas. Furthermore, a mixing channel 10 can be present before or downstream of the mixing zone 12 and after or upstream of the inlet into the breaker chamber 2 or breaker chamber housing 3, and the first partial gas flow 11*a* can be mixed in the mixing channel 10 with the intermediately stored cold gas 111 and in particular with a precooled second partial gas flow 11*b* and optionally a third or further partial gas flow 11*c*. The mixing channel 10 is an optional element. For example, it is also possible for gas jets to be formed in the first partial gas flow 11*a* and in the forcibly displaced cold-gas flow 111 and to be directed towards one another such that they swirl one another in the region of the mixing zone 12 and are mixed. In particular, the hot and cold gas jets form eddies with one another to achieve a turbulent mixture of the first partial gas flow 11*a* and the cold gas 111 before flowing off into the breaker chamber housing 3. As a result, even without or in addition to the mixing channel 10, the quenching gas 11 is effectively cooled before it flows off or when it flows off into the breaker chamber housing 3.

Figure 3:
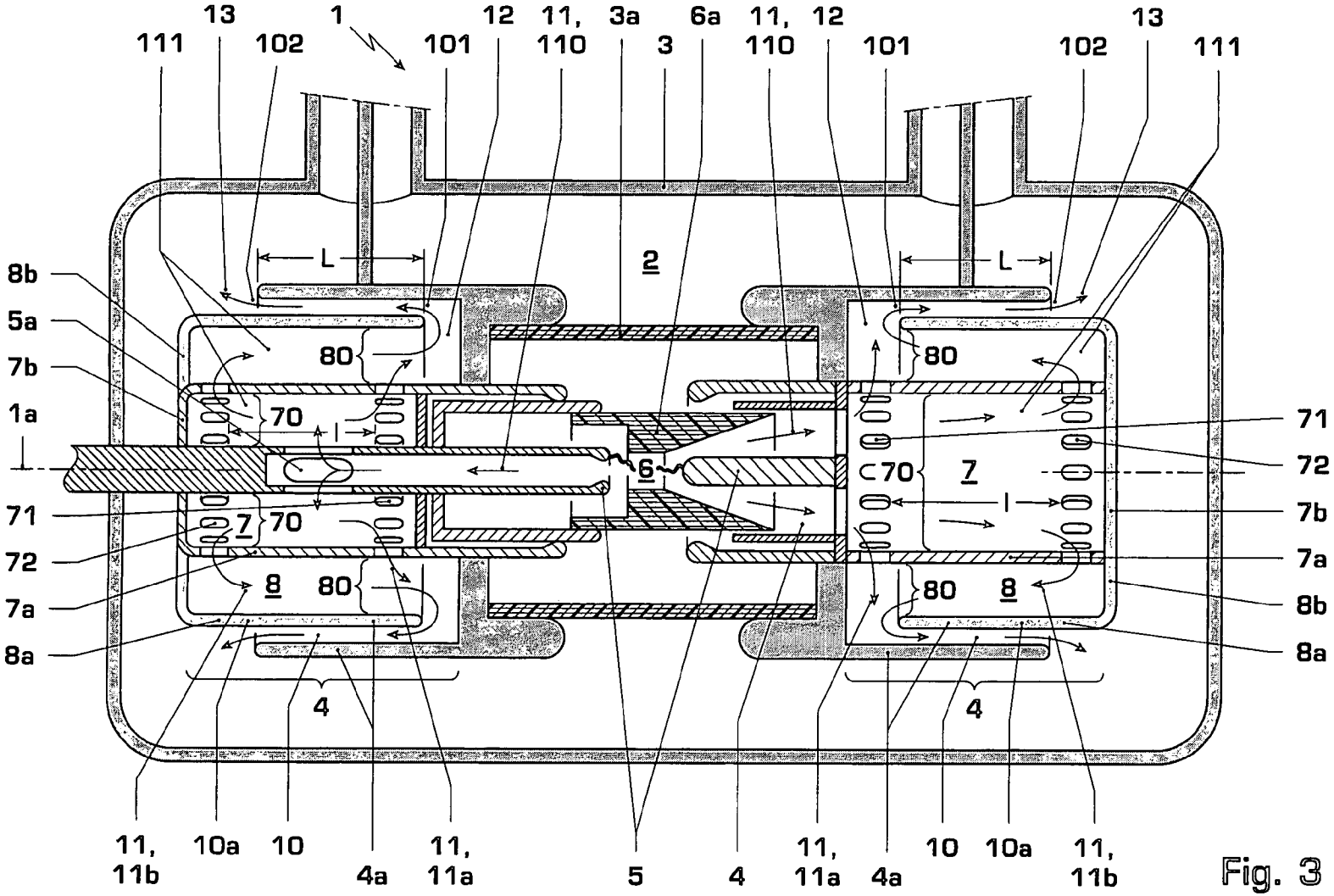
FIG. 3 second embodiments each having two partial flows on the moveable-contact side and the fixed-contact side.
Figure 4:
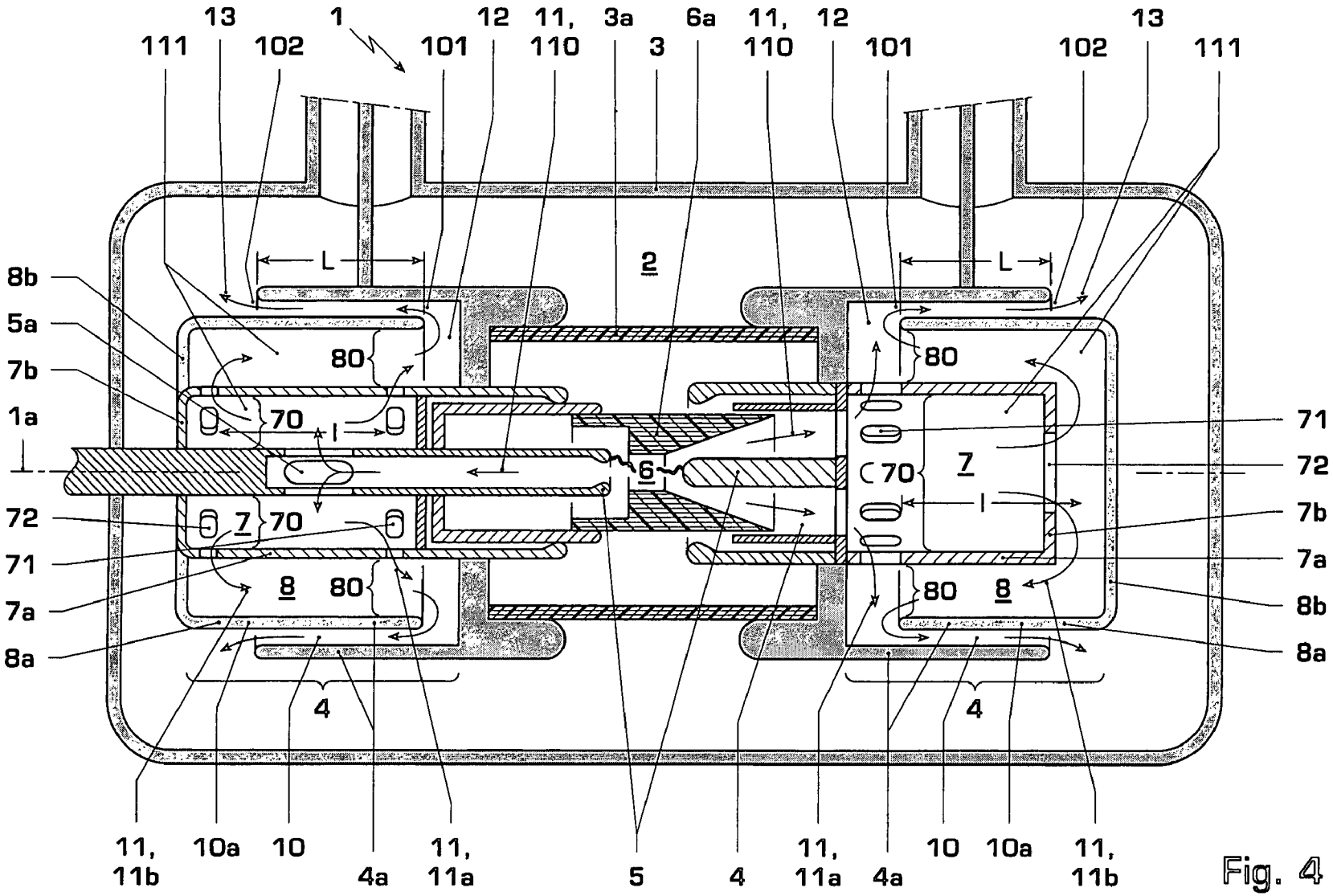
FIG. 4 third embodiments with opening slots in the intermediate storage volume.

Preferably, the storage capacity of the intermediate storage volume 7, 8 shall be designed according to a desired mixing duration and mixing temperature of the first partial gas flow 11*a* with the intermediately stored cold gas 111. In addition, a path difference between the longer path and the shorter path can be designed to be equal to a throughflow length through the intermediate storage volume 7, 8. For example, as shown in FIGS. 3 and 4, the path difference is 2*1, wherein 1=axial extent of the intermediate storage volume 7, 8 through which the second partial gas flow 11*b* flows, initially in one axial direction and then, after being deflected, in the opposite axial direction.

Particularly preferred, the first partial gas flow 11*a* flows out into the breaker chamber housing 3 along a minimum path whilst bypassing the intermediate storage volume 7, 8; and/or the second partial gas flow 11*b* flows out into the breaker chamber housing 3 along a maximum path through the intermediate storage volume 7, 8; and/or a further partial gas flow 11*c* (FIG. 8) flows out into the breaker chamber housing 3 at least in part or section-wise through the intermediate storage volume 7, 8.

Figure 7:
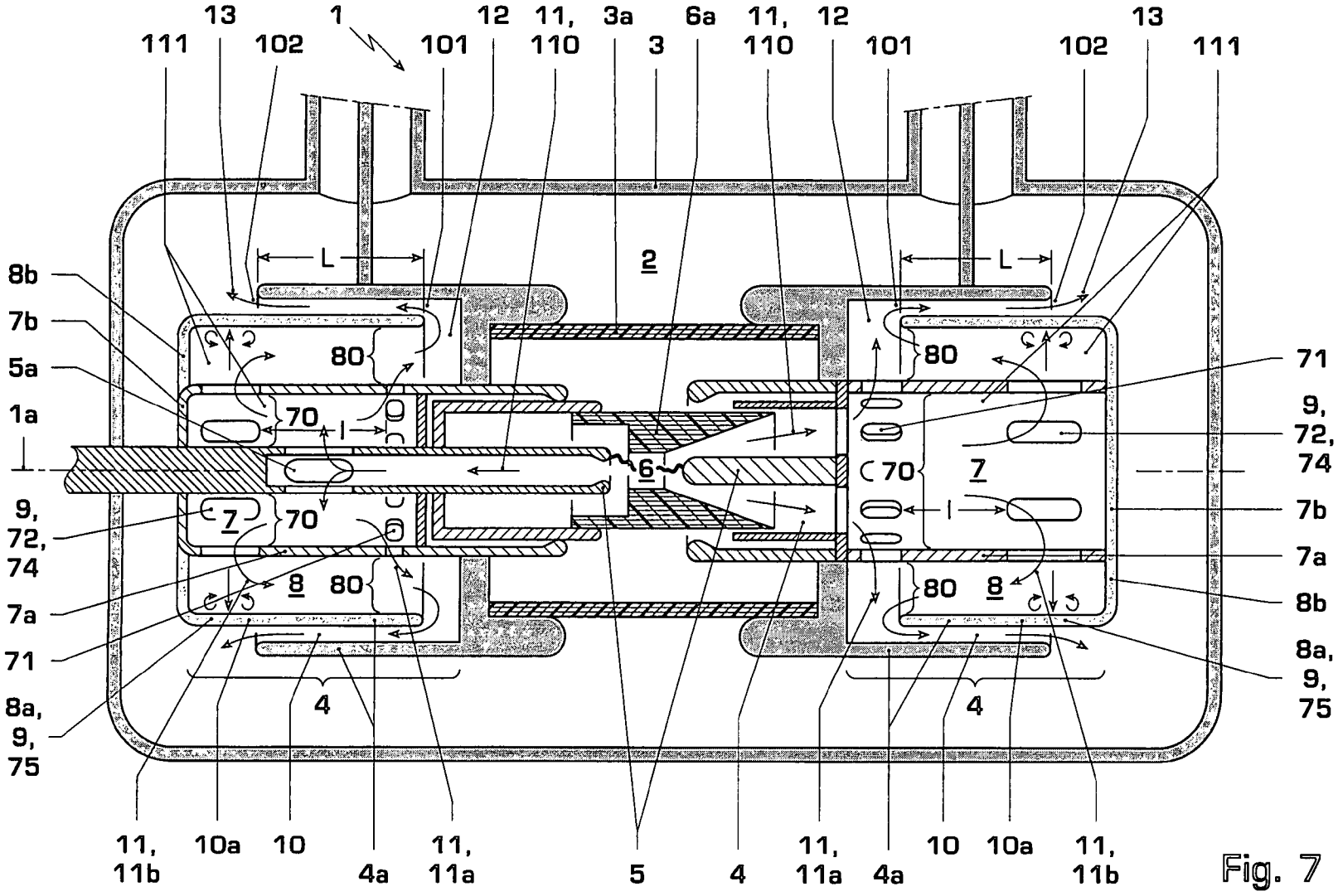
FIGS. 7-8 fifth embodiments with gas-jet swirling for precooling the quenching gas.
Figure 8:
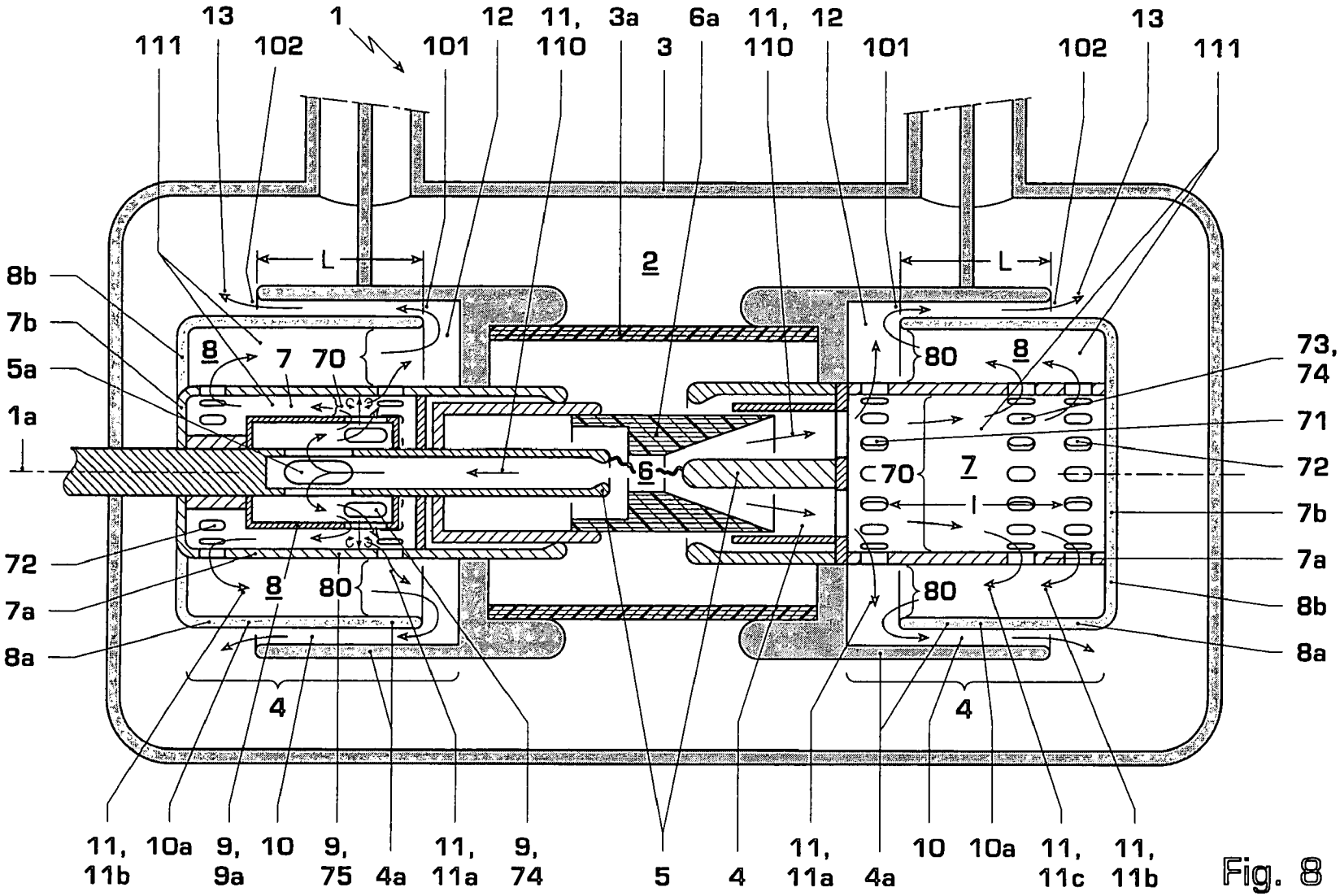
Figure 9:
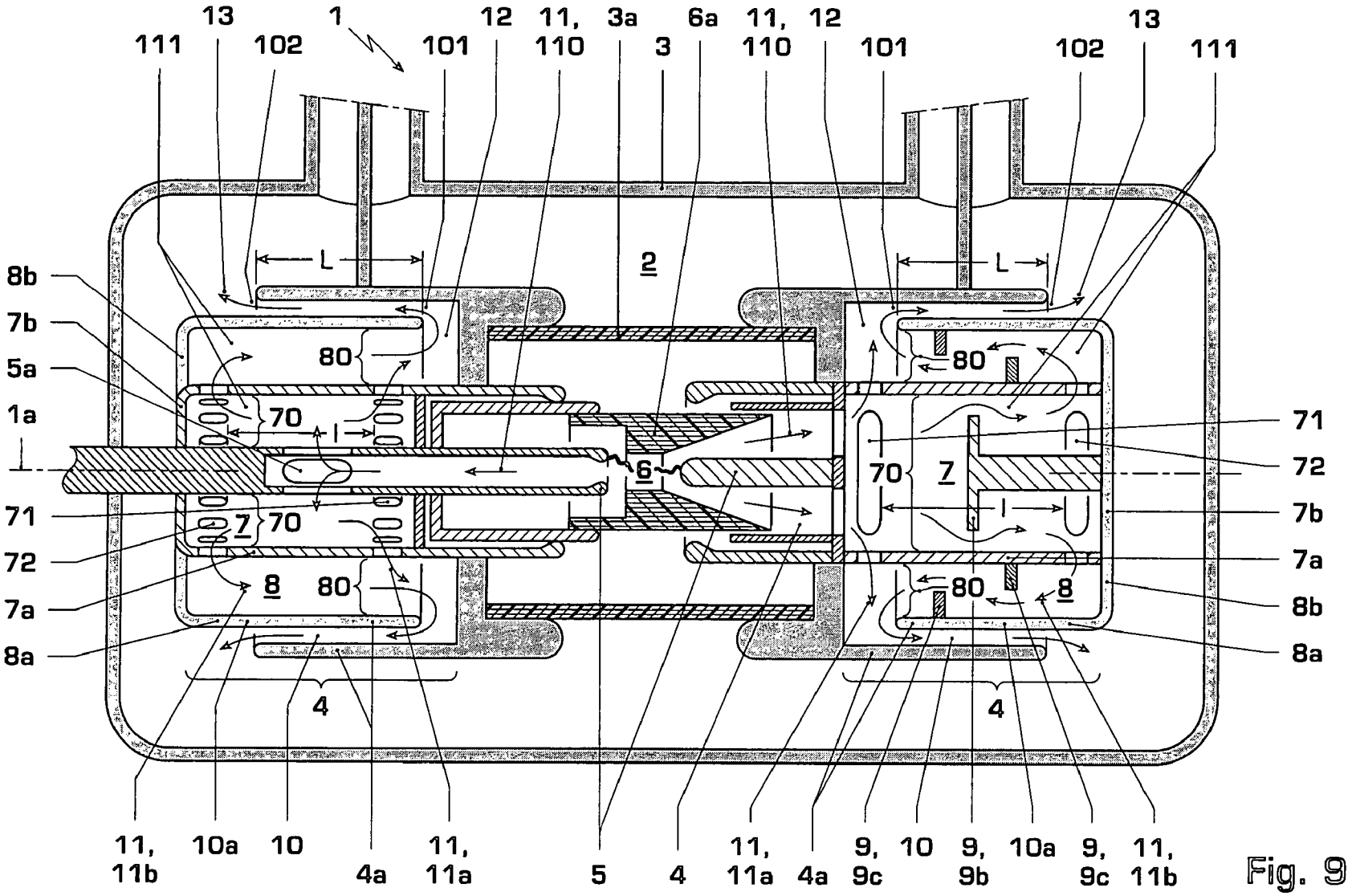
FIG. 9 sixth embodiments with further mechanisms for precooling the second partial gas flow.

Furthermore, the quenching gas 11 can be precooled using auxiliary means for precooling 9, 9*a*, 9*b*, 9*c*; 74, 75 in the exhaust volume 4 of the breaker device 1 (FIGS. 5-9). In particular, the hot gas 110 can be precooled before it is split up into the partial gas flows 11*a*, 11*b*, 11*c* (FIG. 8, left-hand side); and/or the first partial gas flow 11*a* and/or the second partial gas flow 11*b* and possibly a further partial gas flow 11*c* can be precooled. In particular, a gas jet can be formed in the quenching gas 11 by means of a jet-forming outflow opening 74 in the intermediate storage volume 7, 8 and/or in a secondary volume 9*a*, which gas jet is guided onto a baffle wall 75 and is swirled there (FIGS. 5-8); and/or the quenching gas 11 can also be guided onto a baffle plate 9*b* and cooled there (FIG. 9); and/or an extended path, in particular a meandering path, can be defined in the quenching gas 11 by means of guiding means 9*c*, and/or a recirculation area can be formed by means of swirling means 9*c* (FIG. 9). Other auxiliary means which have not been mentioned for quenching gas cooling can also be used, in addition.

The subject matter of the invention is also an electrical breaker device 1, which will be explained in more detail first with reference to FIG. 3. The breaker device 1 comprises a breaker chamber 2, which is surrounded or enclosed by a breaker chamber housing 3 and has an arc-quenching zone 6 and an exhaust volume 4 for cooling hot quenching gas 11, 110. The arc-quenching zone 6 extends between the contacts 5 of the arcing contact system 5 and is laterally surrounded by the insulating nozzle 6*a*. The arcing contacts 5 typically comprise a contact pin and a tulip contact, of which at least one is moveable by a breaker drive (not illustrated). By way of example, in the figures the contact pin is illustrated on the right-hand side as a fixed contact, and the tulip contact is illustrated on the left-hand side as the moveable contact. The tulip contact can at the same time be in the form of a hollow exhaust outflow pipe having a hollow contact outflow opening 5*a*. The rated current contacts, which, for their part, are surrounded by the breaker chamber insulator 3*a*, are arranged concentrically with respect to the arcing contact system 5.

At the beginning of a switching operation, an exhaust region 7, 8 of the exhaust volume 4 is filled with cold gas 111. Means 71, 72, 73; 7*a*, 7*b*; 8*a*, 8*b* for splitting the hot quenching gas 11, 110 up into at least two partial gas flows 11*a*, 11*b*, 11*c* are provided. In the exhaust region 7, 8 an intermediate storage volume 7, 8 for storing cold gas 111 is arranged, a first means 71; 101, 102 being provided which guides the first partial gas flow 11*a* into the breaker chamber housing 3 whilst bypassing the intermediate storage volume 7, 8, and a second means 7*a*, 7*b*, 72 being provided which guides the second partial gas flow 11*b* towards the stored cold gas 111 and, as a result, causes the stored cold gas 111 to be forcibly displaced out of the intermediate storage volume 7, 8.

FIGS. 3-9 show in this regard exemplary design embodiments. A shorter path for the first partial gas flow 11*a* and a longer path for the second partial gas flow 11*b* and possibly for at least one further partial gas flow 11*c* shall be predetermined in the exhaust region 7, 8 between the arc-quenching zone 6 and the breaker chamber housing 3. Preferably, a path length difference 2*1 between the longer path and the shorter path is predetermined by a throughflow length 2*1 through the intermediate storage volume 7, 8. The path length difference or throughflow length may also comprise two or more subpaths of unequal lengths (FIGS. 5-8).

In FIGS. 3-9, the intermediate storage volume 7, 8 has an inlet opening 70 and an outlet opening 80, the first means 71 guiding the first partial gas flow 11*a* towards the outlet opening 80 whilst bypassing the intermediate storage volume 7, 8, and the second means 7*a*, 7*b*, 72 guiding the second partial gas flow 11*b* or possibly further partial gas flows 11*c* towards the inlet opening 70 and through the intermediate storage volume 7 towards the outlet opening 80.

A mixing zone 12 is provided in the region of an outlet opening 80 of the intermediate storage volume 7, 8 for mixing the first partial gas flow 11*a* with the cold gas 111, which is stored in the intermediate storage volume 7, 8 and which is forcibly displaced out of the intermediate storage volume 7, 8 by the second partial gas flow 11*b*, such that the first partial gas flow 11*a* and the intermediately stored cold gas 111 are mixed with one another before flowing off into the breaker chamber housing 3.

The mixing zone 12 can at the same time be in the form of a low pressure zone 12 for sucking the stored cold gas 111 out of the intermediate storage volume 7, 8. This can be achieved, for example, by the flow ratios and, in particular, the flow rates of the partial flows 11*a*, 11*b* and possibly 11*c* in the region of the low pressure zone 12. Furthermore, the mixing zone 12 can also be in the form of a swirling zone 12 for the first partial gas flow 11*a* and the cold gas 111 and, in particular, for gas jets of the first partial gas flow 11*a* and of the cold gas 111.

Figure 5:
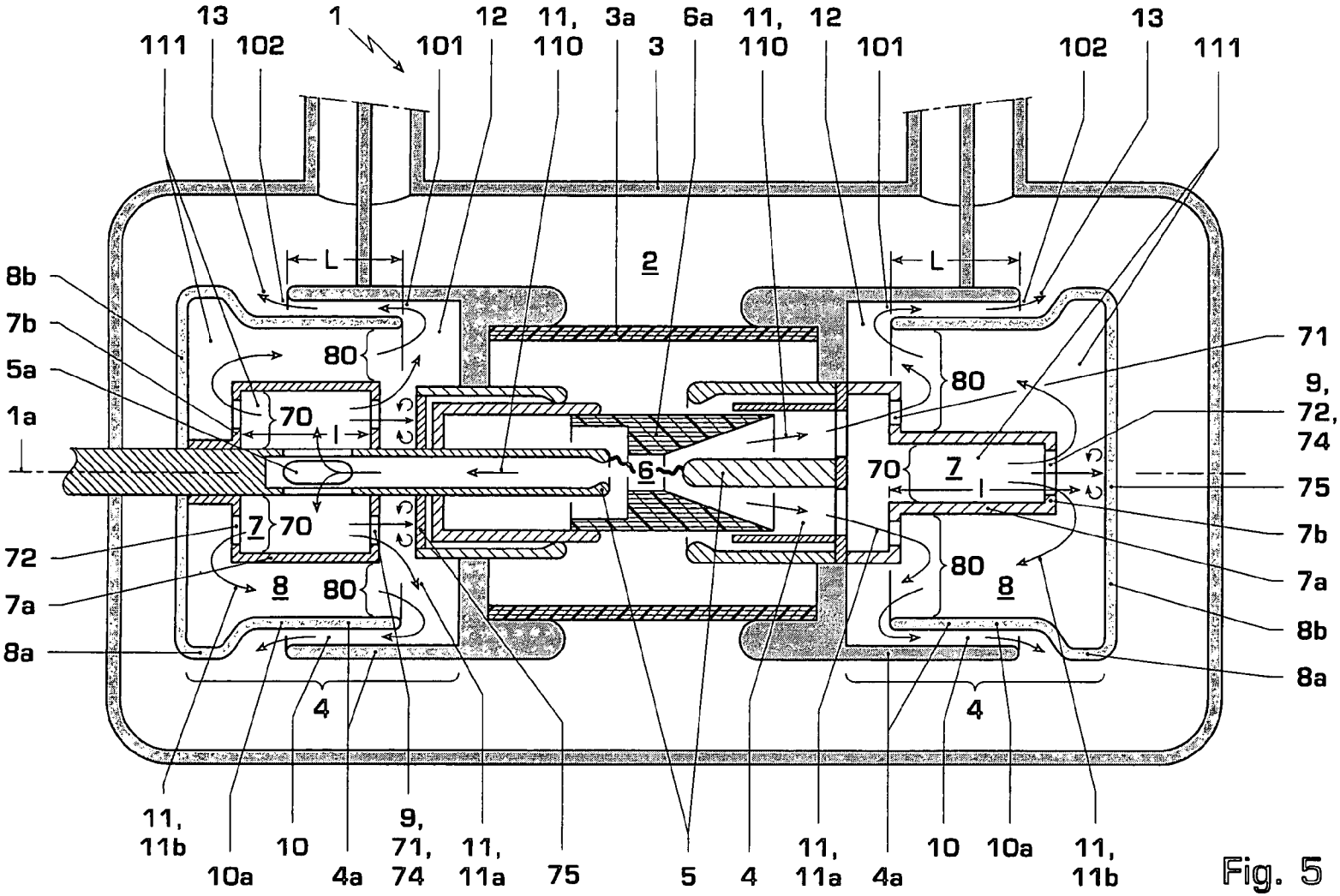
FIGS. 5, 6 fourth embodiments with axial openings in the intermediate storage volume and radial gas outlet from the exhaust.
Figure 6:
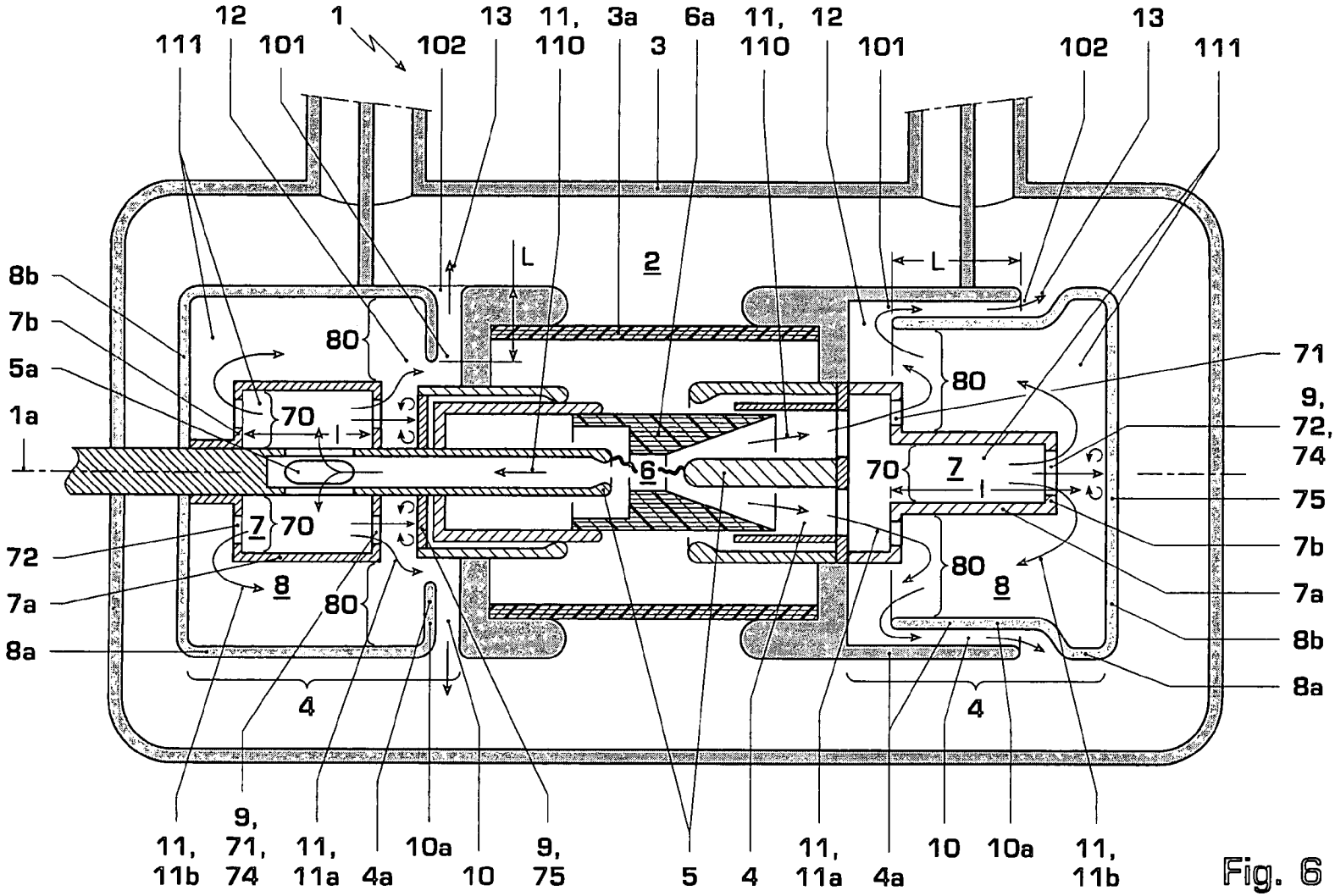

Furthermore, a mixing channel 10 can be arranged after or downstream of the mixing zone 12 and before or upstream of the inlet into the breaker chamber housing 3, in which mixing channel 10 additional mixing of the first partial gas flow 11*a* with the cold gas 111, which has been forcibly displaced out of the intermediate storage volume 7, 8, and, in particular, with a precooled second partial gas flow 11*b* and possibly a further partial gas flow 11*c* takes place. The mixing channel 10 is, for example, separated from the intermediate storage volume 8 by an inner channel wall 10*a* and is connected to it via a channel inlet opening 101. The channel inlet opening 101 therefore acts as an outflow opening out of the intermediate storage volume 7, 8, and the channel outlet opening acts as an actual exhaust opening 102. The mixing channel 10 has a diameter D and has a length L between the channel inlet opening 101 and the channel outlet opening 102. The diameter D and the length L should be dimensioned such that efficient mixing of the already premixed partial gas flows 11*a*, 11*b*, 11*c* with the cold gas 111 and with one another is realized. The mixing channel 10 may be aligned or oriented axially (FIGS. 3-4, 7-9) and/or radially (FIGS. 5-6).

The storage capacity of the intermediate storage volume 7, 8 is dimensioned such that a desired mixing duration and mixing temperature of the first partial gas flow 11*a* with the intermediately stored cold gas 111 can be achieved. As well, the throughflow length, for example 2*1 in FIGS. 3-4, through the intermediate storage volume 7, 8 shall be dimensioned such that a desired time delay of the second partial gas flow 11*a* in the intermediate storage volume 7, 8 relative to the first partial gas flow 11*b* can be achieved.

FIGS. 3-9 also show preferred designs of the breaker device 1. The exhaust volume 4 is enclosed by an exhaust housing 4*a*, which has an outflow opening 101 and an exhaust opening 102 towards the breaker chamber housing 2. The intermediate storage volume 7, 8 is formed by a body 7*a*, 7*b*, 8*a*, 8*b* through which a flow can pass and which is arranged in the exhaust volume 4. The body 7*a*, 7*b*, 8*a*, 8*b* through which a flow can pass has a first opening 71 for branching off the first partial gas flow 11*a* in a region of the body 7*a*, 7*b*, 8*a*, 8*b* which faces the arc-quenching zone 6 and, for the second partial gas flow 11*b*, a second opening 72 and possibly, for a further assisting partial gas flow 11*c*, a third or further opening 73 in a region of the body 7*a*, 7*b*, 8*a*, 8*b* which faces away from the arc-quenching zone 6.

In order to provide a minimum path for the first partial gas flow 11*a*, the first opening 71 is preferably arranged close to the outflow opening 101, in particular radially opposite the outflow opening 101; and/or, in order to provide a maximum path for the second partial gas flow 11*b*, the second opening 72 is arranged far removed from the exhaust outflow opening 101, in particular at a maximum axial distance from the outflow opening 101; and/or a third or further opening 73 is arranged for a further partial gas flow 11*c* in the axial direction 1*a* between the first and the second openings 71, 72 (FIG. 8, right-hand side). With the aid of the further partial gas flow 11*c*, the long path can be split up into at least two subpaths 11*b*, 11*c*. As a result, the mixing of the quenching gas 11 in the outer volume 8 can be improved.

Preferably, the second opening 72 interacts with a deflecting device 7*b*, 8*b*, 8*a* for guiding the stored cold gas 111 and the second partial gas flow 11*b* back towards the outlet opening 80 of the intermediate storage volume 7, 8; and/or the path length difference between the shorter path 11*a* for the first partial gas flow and the longer path 11*b* for the second partial gas flow is given by the axial distance between the first and the second openings 71, 72. The openings 71, 72, 73 may be holes or slots in a wall 7*a*, 7*b* of the body 7*a*, 7*b*, 8*a*, 8*b*. The openings 71, 72, 73 can be arranged in a radial wall 7*a* and/or in an axial wall 7*b* of the body 7*a*, 7*b*, 8*a*, 8*b*. A number, size (i.e. cross-sectional area $A_1$, $A_2$, $A_3$) and position of the first, second and possibly third openings 71, 72, 73 can be designed such that the first partial gas flow 11*a* can still largely be mixed in the exhaust volume 4 with the stored cold gas 111. In particular, a plurality of holes or slots 72 and possibly 73 shall be arranged on the circumference and/or along the axial extent in the body 7*a*, 7*b*, 8*a*, 8*b* through which a flow can pass such that a hot-gas front is formed in the second and possibly further partial gas flows 11*b*, 11*c* and no cold-gas pockets remain in the intermediate storage volume 7, 8. In the region of the openings 71, 72, 73, the total throughflow cross section $A_0=A_1+A_2$, possibly $A_0=A_1+A_2+A_3$, is typically at its smallest and the throughflow rate is at its greatest.

The body 7*a*, 7*b*, 8*a*, 8*b* through which a flow can pass may comprise an inner cylinder 7*a*, 7*b* and an outer cylinder 8*a*, 8*b*. The inner cylinder and the outer cylinder 7*a*, 7*b*, 8*a*, 8*b* are preferably arranged coaxially with respect to one another and with respect to the breaker axis 1*a*. The inner cylinder and the outer cylinder 7*a*, 7*b*, 8*a*, 8*b* delimit the intermediate storage volume 7, 8 radially by means of at least two outer or cylinder surfaces 7*a*, 8*a* and axially at the ends by means of associated base surfaces 7*b*, 8*b*. The inner cylinder 7*a*, 7*b* defines an inner volume $V_1$ and has an inlet opening 70 towards the arc-quenching zone 6 for the second partial gas flow 11*a*. The outer cylinder 8*a*, 8*b* surrounds the inner cylinder 7*a*, 7*b*, defines an outer volume $V_2$ and has an outlet opening 80 towards the arc-quenching zone 6 for the stored cold gas 111 and the second partial gas flow 11*b*. The inner cylinder 7*a*, 7*b* and the outer cylinder 8*a*, 8*b* are connected to one another by means of the second opening 72 and possibly the third opening 73. The inner and outer volumes $V_1$, $V_2$ shall preferably be matched to one another such that a desired storage capacity for the cold gas 111 and a desired throughflow dynamics for the second partial gas flow 11*b* can be realized.

The intermediate storage volume 7, 8, the first means 71; 101, 102 and the second means 7*a*, 7*b*, 72 can be arranged in the exhaust region 7, 8 of a first and/or a second contact 5 of the breaker device 1. The breaker device 1 may be a high-voltage circuit breaker 1 or a high-current circuit breaker or a switch disconnector or the like.

In detail, FIGS. 3-8 show the following variants: FIG. 3: left-hand side or moveable-contact side and right-hand side or fixed-contact side in each case two partial gas flows 11*a*, 11*b* realized by holes 71, 72; FIG. 4: left-hand side with slots 71, 72 instead of holes and right-hand side with large-area second opening 72 in rear wall 7*b* of the inner cylinder 7*a*, 7*b*; FIGS. 5-6: axially oriented first and second openings 71, 72 as well as inner cylinder 7*a*, 7*b* axially shortened (left-hand side) and/or reduced in size radially (right-hand side); furthermore mixing channel 10 with radial exhaust or gas outlet 102; FIG. 7: slots 72 for the second partial gas flow 11*b* dimensioned such that a hot-gas jet is produced and is rebounded against the outer wall 8*a* of the outer cylinder 8*a*, 8*b*, as discussed further below; FIG. 8: secondary volume 9*a* for building up a hot-gas stream or jet (left-hand side) and third openings 73 for splitting a third partial gas flow 11*c*; and FIG. 9: first partial gas flow 11*a* or, as shown, second partial gas flow 11*b* with further cooling mechanisms 9.

Auxiliary means 9, 9*a*, 9*b*, 9*c*; 74, 75 for precooling the quenching gas 11 can be arranged in the exhaust volume 4 of the breaker device 1. The auxiliary means 9, 9*a*, 9*b*, 9*c*; 74, 75 can be arranged in the hot-gas flow 110 before it is split up into the partial gas flows 11*a*, 11*b*, 11 and/or in the first partial gas flow and/or in the second partial gas flow 11*a*, 11*b* and possibly in the further partial gas flow 11*c*. Such auxiliary means relate, on the one hand, to jet-forming outflow openings 74 in the intermediate storage volume 7, 8 and/or in a secondary volume 9*a* for forming gas jets as well as a baffle wall 75 for swirling purposes and intensive turbulent convective cooling of the gas jets. Further details on this cooling mechanism can be gleaned from the European patent application EP 1 403 891 A1, published before the priority date, and the international patent application PCT/CH2004/000752, not published before the priority date, which are hereby incorporated by reference in the description to their entire disclosure content. In particular, an outflow or ejection characteristic of the openings 71, 72, 73 can be matched to a distance from the opposite baffle wall 75, for example the outer wall 8*a* or rear wall 8*b* of the outer cylinder 8*a*, 8*b*, such that the eddies are formed at or in the region of the baffle wall 75. In addition, the quenching gas and in particular the eddies can be guided on circular paths, helical paths or on spiral paths. In particular, the circular paths, helical paths or spiral paths can be guided along the baffle wall 75 about the inner cylinder 7*a*, 7*b* towards the outflow opening 80 of the intermediate storage volume 7, 8. As shown in FIG. 8, the secondary volume 9*a* can be in the form of, for example, a cylindrical metal sleeve 9*a*. The jet-forming metal sleeve 9*a* can be arranged, for example, on the tulip-contact side or moveable-contact side concentrically about the hollow-contact outflow opening 5*a* and also within the intermediate storage volume 7, 8 or on the quenching gas outflow path 11 upstream of the intermediate storage volume 7, 8. As shown in FIG. 9, the auxiliary means may also comprise a baffle plate 9*b* and/or guiding means 9*c* and/or swirling means 9*c* for the quenching gas 11.

Another aspect of the invention relates to a method for cooling a quenching gas 11 in an electrical breaker device 1 according to the preamble of the independent claim 1, wherein gas jets in the first partial gas flow 11*a* and in the cold gas 111 are produced and are directed towards one another in the region of a mixing zone 12, and, as a result, are mixed. In particular, the hot and cold gas jets form eddies with one another to achieve a turbulent mixture of the hot first partial gas flow 11*a* with the cold gas flow 111. The turbulent mixing of the hot and cold gas jets can occur during or before or after the exhaust gas 11; 11*a*, 11*b*, 11*c*; 110, 111; 13 is leaving the exhaust region 7, 8 and is entering the breaker chamber housing 3.

In yet another aspect, the invention relates to an electrical breaker device 1 according to the preamble of the independent claim 11, wherein a mixing zone 12 for mixing the first partial gas flow 11*a* with the cold gas 111 is provided in the region of an outlet opening 80 of the intermediate storage volume 7, 8, jet-forming means for forming gas jets of the first partial gas flow 11*a* and of the cold gas 111 are provided, and the mixing zone 12 serves as a swirling zone 12 for the gas jets of the first partial gas flow 11*a* and the cold gas 111. In particular, the hot and cold gas jets are directed towards one another in the mixing zone 12 and, as a result, form eddies with one another to achieve a turbulent mixture of the hot first partial gas flow 11*a* with the cold gas flow 111. The turbulent mixing of hot and cold gas jets can occur during or before or after the exhaust gas 11; 11*a*, 11*b*, 11*c*; 110, 111; 13 is leaving the exhaust region 7, 8 and is entering the breaker chamber housing 3.

LIST OF REFERENCE SYMBOLS

1 Electrical breaker device, interrupter unit; high-voltage circuit breaker
1*a* Central axis, breaker axis
2 Breaker chamber, breaker chamber volume
3 Breaker chamber housing, breaker chamber wall
3*a* Breaker chamber insulator
4 Exhaust volume
4*a* Exhaust housing, exhaust wall; current connection fittings
5 Arcing contact system, first contact, contact pin, fixed contact; second contact, tulip contact, hollow contact, moveable contact
5*a* Hollow contact outflow opening
6 Arc-quenching zone
6*a* Insulating nozzle
7, 8 Cold-gas filled exhaust region, intermediate storage volume, cold-gas reservoir
7 First volume $V_1$, inner volume
7*a*, 7*b*, 8*a*, 8*b* Body through which a flow can pass
7*a*, 7*b* Outer wall, rear wall of the inner volume; body through which a flow can pass
70 Inlet opening into intermediate storage volume
71 First outflow opening(s)
72 Second outflow opening(s), throughflow opening(s)
73 Third outflow opening(s), further outflow opening(s), throughflow opening(s)
74 Jet-forming outflow opening(s)
75 Baffle wall
8 Second volume $V_2$, outer volume
80 Outflow opening in intermediate storage volume
8*a*, 8*b* Outer wall, rear wall of the intermediate storage volume or cold-gas reservoir
9 Auxiliary means for precooling
9*a* Secondary volume, precooling volume, jet-forming volume $V_3$
9*b* Baffle plate
9*c* Guiding means, swirling means for quenching gas
10 Mixing channel, additional mixing length
10*a* Inner channel wall
101 Channel inlet opening, outflow opening
102 Channel outlet opening, exhaust opening
11 Quenching-gas flow
11*a*, 11*b* First, second partial gas flow
11*c* Third partial gas flow, further partial gas flows
110 Hot gas
111 Cold gas
12 Mixing zone; low pressure zone; swirling zone
13 Mixed exhaust gas
$A_1$, $A_2$, $A_3$ Cross-sectional area of the first, second, third outflow opening(s)
$A_0$ Total outflow area
L, D Length, diameter of the mixing channel
1 Distance between outflow openings

The invention claimed is:

1. A method for cooling a quenching gas in an electrical breaker device for electrical power supply systems, the breaker device comprising:

a breaker chamber which is enclosed by a breaker chamber housing, wherein when a switching operation hot quenching gas flows from an arc-quenching zone to an exhaust which is filled with cold gas, wherein the hot quenching gas is split up into at least two partial gas flows, wherein a) at least part of the cold gas is intermediately stored in an exhaust region, and a first partial gas flow is guided to bypass the intermediately stored cold gas and flows off into the breaker chamber, and with an aid of a second partial gas flow, the intermediately stored cold gas is forcibly displaced out of the exhaust region, wherein b) the first partial gas flow and the intermediately stored cold gas are mixed with one another in a mixing zone before flowing off into the breaker chamber housing, and wherein c) a mixing channel is present downstream of the mixing zone and upstream of the inlet into the breaker chamber housing, and d) the first partial gas flow is additionally mixed in the mixing channel with the intermediately stored cold gas and with a precooled second partial gas flow and a further partial gas flow.

2. The method for cooling a quenching gas as claimed in claim 1, wherein a) hot gas jets in an area of the first partial gas flow and cold gas lets in an area of in the forcibly displaced cold gas flow are directed towards one another in the region of the mixing zone, and, as a result, are the first partial gas flow and the forcibly displaced cold gas mixed, and b) the hot and cold gas jets form eddies with one another to achieve a turbulent mixture of the first partial gas flow and the cold gas before flowing off into the breaker chamber housing.

3. The method for cooling a quenching gas as claimed in claim 1, wherein in the region of the mixing zone, a low pressure is produced by the first partial gas flow, by which low pressure the intermediately stored cold gas is sucked out of the intermediate storage volume.

4. The method for cooling a quenching gas as claimed in claim 1, wherein a) the second partial gas flow is guided towards the intermediately stored cold gas, b) the first partial gas flow is guided into the breaker chamber housing via a shorter path, and the second partial gas flow and a further or third partial gas flow assisting the second partial gas flow is guided into the breaker chamber housing via a longer path.

5. The method for cooling a quenching gas as claimed in claim 1, wherein a) the intermediately stored part of the cold gas is stored intermediately in the exhaust region in an intermediate storage volume, and b) the intermediate storage volume has an inlet opening and an outlet opening for the second partial gas flow and a further partial gas flow and has, in the region of the outlet opening, the mixing zone, in which the stored cold gas is mixed with the first partial gas flow.

6. The method for cooling a quenching gas as claimed in claim 1, wherein a) the storage capacity of the intermediate storage volume is designed according to a desired mixing duration and mixing temperature of the first partial gas flow with the intermediately stored cold gas, and b) a path difference between the longer path and the shorter path is designed to be equal to a throughflow length through the intermediate storage volume.

7. The method for cooling a quenching gas as claimed in claim 1, wherein a) the first partial gas flow flows off into the breaker chamber housing via a minimum path whilst bypassing the intermediate storage volume, and b) the second partial gas flow flows off into the breaker chamber housing via a maximum path through the intermediate storage volume, and c) a further partial gas flow flows off into the breaker chamber housing at least in parts through the intermediate storage volume.

8. The method for cooling a quenching gas as claimed in claim 1, wherein a) the quenching gas is precooled using auxiliary means for precooling in the exhaust volume of the breaker device, b) such that at least one of the hot gas is precooled before it is split up into the partial gas flows, the first partial gas flow, the second partial gas flow, and a further partial gas flow are precooled.

9. The method for cooling a quenching gas as claimed in claim 1, wherein a) a gas jet is formed in the quenching gas by means of a jet-forming outflow opening in the intermediate storage volume or in a secondary volume, which gas jet is guided onto a baffle wall and is swirled there, c) an extended path, is predetermined in the quenching gas by at least one of guiding means, and a recirculation area is formed by means of swirling means.

10. The method for cooling a quenching gas as claimed in claim 1 wherein b) the first partial gas flow is guided into the breaker chamber housing via a shorter path, and the second partial gas flow and a or third partial gas flow assisting the second partial gas flow is guided into the breaker chamber housing via a longer path.

11. The method for cooling a quenching gas as claimed in claim 1 wherein a further partial gas flow flows off into the breaker chamber housing at least in parts through the intermediate storage volume.

12. The method for cooling a quenching gas as claimed in claim 1 wherein an extended path is predetermined in the quenching gas by at least one of guiding means, and a recirculation area is formed by means of swirling means.

13. An electrical breaker device for an electrical power supply system, comprising:

a breaker chamber which is surrounded by a breaker chamber housing and has an arc-quenching zone and an exhaust volume for-cooling hot quenching gas, wherein an exhaust region of the exhaust volume is filled with cold gas at the beginning of a switching operation, wherein means for splitting the hot quenching gas up into at least two partial gas flows are provided, wherein a) an intermediate storage volume for storing cold gas is arranged in the exhaust region, b) a first means is present which guides the first partial gas flow into the breaker chamber housing whilst bypassing the intermediate storage volume, and c) a second means is present which guides the second partial gas flow towards the stored cold gas and, as a result, causes a displacement of the stored cold gas out of the intermediate storage volume, wherein d) a mixing zone is provided in the region of an outlet opening of the intermediate storage volume for mixing the first partial gas flow with the cold gas such that the first partial gas flow and the intermediately stored cold gas are mixed with one another before flowing off into the breaker chamber housing, and wherein e) a mixing channel is arranged downstream of the mixing zone and upstream of the inlet into the breaker chamber housing, and f) in the mixing channel additional mixing of the first partial gas flow with the cold gas, which has been forcibly displaced out of the intermediate storage volume, and with a precooled second partial gas flow and a further partial gas flow takes place.

14. The electrical breaker device as claimed in claim 13, wherein a) the mixing zone is at the same time designed as a swirling zone for the first partial gas flow and the cold gas and b) in particular that the mixing zone is designed as a swirling zone for gas jets of the first partial gas flow and the cold gas, particularly preferred that the hot and cold gas jets are directed towards one another in the mixing zone.

15. The electrical breaker device as claimed in claim 13, wherein at least one of a) the mixing channel is separated from the intermediate storage volume by an inner channel wall and is connected to the intermediate storage volume via a channel inlet opening, and b) a diameter D and a length L of the mixing channel are dimensioned such that efficient mixing of the already premixed partial gas flows with the cold gas and with one another is realized, and c) the mixing channel is aligned axially or radially.

16. The electrical breaker device as claimed in claim 13, wherein the mixing zone is at the same time designed as a low pressure zone for sucking the stored cold gas out of the intermediate storage volume.

17. The electrical breaker device as claimed in claim 13, wherein a) a shorter path for the first partial gas flow and a longer path for the second partial gas flow and a further partial gas flow are predetermined in the exhaust region between the arc-quenching zone and the breaker chamber housing, and b) that a path length difference between the longer path and the shorter path is defined by a throughflow length through the intermediate storage volume.

18. The electrical breaker device as claimed in claim 13, wherein a) the intermediate storage volume has an inlet opening and an outlet opening, b) the first means guides the first partial gas flow towards the outlet opening whilst bypassing the intermediate storage volume, and c) the second means guides the second partial gas flow or a third partial gas flows towards the inlet opening and through the intermediate storage volume towards the outlet opening.

19. The electrical breaker device as claimed in claim 13, wherein a) the storage capacity of the intermediate storage volume is designed according to a desired mixing duration and mixing temperature of the first partial gas flow with the intermediately stored cold gas, and b) a throughflow length of the intermediate storage volume is designed according to a desired time delay of the second partial gas flow in the intermediate storage volume in relation to the first partial gas flow.

20. The electrical breaker device as claimed in claim 13, wherein a) the exhaust volume is enclosed by an exhaust housing, which has an outflow opening and an exhaust opening towards the breaker chamber housing, b) the intermediate storage volume is formed by a body through which a flow can pass and which is arranged in the exhaust volume, and c) the body through which a flow can pass has a first opening for branching off the first partial gas flow in a region of the body which faces the arc-quenching zone and has a second opening for the second partial gas flow in a region of the body which faces away from the arc-quenching zone.

21. The electrical breaker device as claimed in claim 20, wherein a) the first opening is arranged close to the outflow opening radially opposite to it, and b) the second opening is arranged far removed from the outflow opening, at a maximum axial distance from the outflow opening, and c) a third or further opening for a third or further partial gas flow is arranged in the axial direction (1*a*) between the first and the second opening.

22. The electrical breaker device as claimed in claim 20, wherein a) the second opening cooperates with a deflecting device for guiding the stored cold gas and the second partial gas flow back towards the outlet opening of the intermediate storage volume, and b) a path length difference between the shorter path for the first partial gas flow and the longer path for the second partial gas flow is defined by the axial distance between the first and the second opening.

23. The electrical breaker device as claimed in claim 20, wherein at least one of a) the openings are holes or slots in a wall of the body, and b) the openings are arranged in a radial wall or in an axial wall of the body, and c) a number, size and position of the first, second and third openings are chosen such that the first partial gas flow can still largely be mixed in the exhaust volume with the stored cold gas.

24. The electrical breaker device as claimed in claim 20, wherein a) the body through which a flow can pass comprises a coaxially arranged inner cylinder, which has an inlet opening for the second partial gas flow towards the arc-quenching zone, b) the body through which a flow can pass comprises an outer cylinder which surrounds the inner cylinder and has an outlet opening for the stored cold gas and the second partial gas flow towards the arc-quenching zone, and c) the inner cylinder and the outer cylinder are in connection with one another via the second opening and a third opening.

25. The electrical breaker device as claimed in claim 13, wherein a) auxiliary means for precooling the quenching gas are arranged in the exhaust volume of the breaker device, b) such that the auxiliary means are arranged in the hot-gas flow before it is split up into the partial gas flows or in the first partial gas flow or in the second partial gas flow.

26. The electrical breaker device as claimed in claim 25, wherein a) the auxiliary means comprise a jet-forming outflow opening in the intermediate storage volume or in a secondary volume for forming gas jets as well as a baffle wall for swirling the gas jets, and b) the auxiliary means comprise a baffle plate, or guiding means, or swirling means for the quenching gas.

27. The electrical breaker device as claimed in claim 13, wherein at least one of a) the intermediate storage volume, the first means and the second means are arranged in the exhaust region of at least one of a first and a second contact of the breaker device, and b) the breaker device is a high-voltage circuit breaker or a high-current circuit breaker or a switch disconnector.

28. A method for cooling a quenching gas in an electrical breaker device for electrical power supply systems, in a high-voltage circuit breaker, the breaker device comprising:

a breaker chamber which is enclosed by a breaker chamber housing, wherein in the event of a switching operation hot quenching gas flows from an arc-quenching zone to an exhaust region which is filled with cold gas, wherein the hot quenching gas is split up into at least two partial gas flows, wherein a) at least part of the cold gas is intermediately stored in the exhaust region, and the first partial gas flow is guided to bypass the intermediately stored cold gas and flows off into the breaker chamber, and b) with the aid of the second partial gas flow, the intermediately stored cold gas is forcibly displaced out of the exhaust region, wherein c) gas jets in an area of first partial gas flow and in an area of the cold gas are directed towards one another in the region of a mixing zone, and, as a result, the first partial gas flow and the cold gas are mixed, and wherein d) a mixing channel is present downstream of the mixing zone and upstream of the inlet into the breaker chamber housing, and e) the first partial gas flow is additionally mixed in the mixing channel with the intermediately stored cold gas and with a precooled second partial gas flow and a further partial gas flow.

29. The method for cooling a quenching gas as claimed in claim 28, wherein the hot and cold gas jets form eddies with one another to achieve a turbulent mixture of the hot first partial gas flow with the cold gas flow.

30. An electrical breaker device for an electrical power supply system, comprising: a breaker chamber which is surrounded by a breaker chamber housing and has an arc-quenching zone and an exhaust volume for cooling hot quenching gas, wherein an exhaust region of the exhaust volume is filled with cold gas at the beginning of a switching operation, wherein means for splitting the hot quenching gas up into at least two partial gas flows are provided, wherein a) an intermediate storage volume for storing cold gas is arranged in the exhaust region, b) a first means is present which guides the first partial gas flow into the breaker chamber housing whilst bypassing the intermediate storage volume, and c) a second means is present which guides the second partial gas flow towards the stored cold gas and, as a result, causes a displacement of the stored cold gas out of the intermediate storage volume, wherein d) a mixing zone for mixing the first partial gas flow with the cold gas is provided in the region of an outlet opening of the intermediate storage volume, jet-forming means for having gas jets in an area of the first partial gas flow and in an area of the cold gas are provided, and the mixing zone serves as a swirling zone for the gas jets of the first partial gas flow and the cold gas, and wherein e) a mixing channel is arranged downstream of the mixing zone and upstream of the inlet into the breaker chamber housing, and f) in the mixing channel additional mixing of the first partial gas flow with the cold gas, which has been forcibly displaced out of the intermediate storage volume, and with a precooled second partial gas flow and a further partial gas flow takes place.

31. The electrical breaker device as claimed in claim 30, wherein the hot and cold gas jets are directed towards one another in the mixing zone and, as a result, form eddies with one another to achieve a turbulent mixture of the hot first partial gas flow with the cold gas flow.

* * * * *